US008274542B2

(12) United States Patent
Sakamoto

(10) Patent No.: US 8,274,542 B2
(45) Date of Patent: Sep. 25, 2012

(54) EXPOSURE DEVICE AND IMAGE FORMING APPARATUS

(75) Inventor: Tetsuya Sakamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 357 days.

(21) Appl. No.: 12/541,420

(22) Filed: Aug. 14, 2009

(65) Prior Publication Data

US 2010/0238257 A1 Sep. 23, 2010

(30) Foreign Application Priority Data

Mar. 23, 2009 (JP) ..... 2009-70917

(51) Int. Cl.
*B41J 27/00* (2006.01)

(52) U.S. Cl. ..... 347/257; 347/222; 347/242; 347/245; 347/263

(58) Field of Classification Search ..... 347/138, 347/263, 257, 242, 245, 222
See application file for complete search history.

(56) References Cited

U.S. PATENT DOCUMENTS

| | | | | |
|---|---|---|---|---|
| 4,743,927 | A * | 5/1988 | Sasaki | 347/130 |
| 4,768,039 | A * | 8/1988 | Akutagawa et al. | 347/222 |
| 5,475,484 | A * | 12/1995 | Kimura | 399/130 |
| 5,752,133 | A * | 5/1998 | Nagase et al. | 399/112 |
| 7,783,225 | B2 * | 8/2010 | Fujiwara | 399/107 |
| 7,825,946 | B2 * | 11/2010 | Sugiyama et al. | 347/242 |
| 2002/0149664 | A1 * | 10/2002 | Nagamine et al. | 347/138 |
| 2004/0228652 | A1 | 11/2004 | Fujiwara | |
| 2010/0245529 | A1 * | 9/2010 | Saiki | 347/238 |

FOREIGN PATENT DOCUMENTS

| | | |
|---|---|---|
| JP | 09-099594 | 4/1997 |
| JP | 2000-203086 | 7/2000 |
| JP | 2004-246347 | 9/2004 |
| JP | 2007-069528 | 3/2007 |

OTHER PUBLICATIONS

Translation of Office Action from Japanese Patent Office in counterpart Japanese Application No. 2009-070917, mailed Feb. 1, 2011.

* cited by examiner

*Primary Examiner* — Charlie Peng
(74) *Attorney, Agent, or Firm* — Sughrue Mion, PLLC

(57) ABSTRACT

The exposure device is provided with: an exposure unit that has one end and a different end, that includes plural light-emitting elements arranged in a first direction along a direction of a rotational axis of a rotating image carrier, and that exposes the image carrier; a one-end-side holding portion that holds a one end part, on the one end side, of the exposure unit; a first reference part that is formed in the one-end-side holding portion, and that serves as a reference for aligning the exposure unit in the first direction by bringing the one end part of the exposure unit into contact with the first reference part; and an application portion that applies, to the one end part of the exposure unit, force with which the one end part of the exposure unit is pressed against the first reference part.

14 Claims, 12 Drawing Sheets

14
45
50
52
52Y
52Z
43
X-DIRECTION
Y-DIRECTION
Z-DIRECTION
OUT SIDE
IN SIDE 14
50
51
51X
51Y
51Z
45
43
Y-DIRECTION
Z-DIRECTION
X-DIRECTION
OUT SIDE
IN SIDE

EXPOSURE DEVICE AND IMAGE FORMING APPARATUS

CROSS REFERENCE TO RELATED APPLICATIONS

This application is based on and claims priority under 35 USC §119 from Japanese Patent Application No. 2009-70917 filed Mar. 23, 2009.

BACKGROUND

1. Technical Field

The present invention relates to an exposure device and an image forming apparatus.

2. Related Art

In recent years, there has been proposed an exposure unit in which plural light-emitting elements are linearly arrayed, used for an image forming apparatus.

SUMMARY

According to an aspect of the present invention, there is provided an exposure device including: an exposure unit that has one end and a different end, that includes plural light-emitting elements arranged in a first direction along a direction of a rotational axis of a rotating image carrier, and that exposes the image carrier; a one-end-side holding portion that holds a one end part, on the one end side, of the exposure unit; a first reference part that is formed in the one-end-side holding portion, and that serves as a reference for aligning the exposure unit in the first direction by bringing the one end part of the exposure unit into contact with the first reference part; and an application portion that applies, to the one end part of the exposure unit, force with which the one end part of the exposure unit is pressed against the first reference part.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below in detail with reference to the accompanying drawings.

Figure 1:
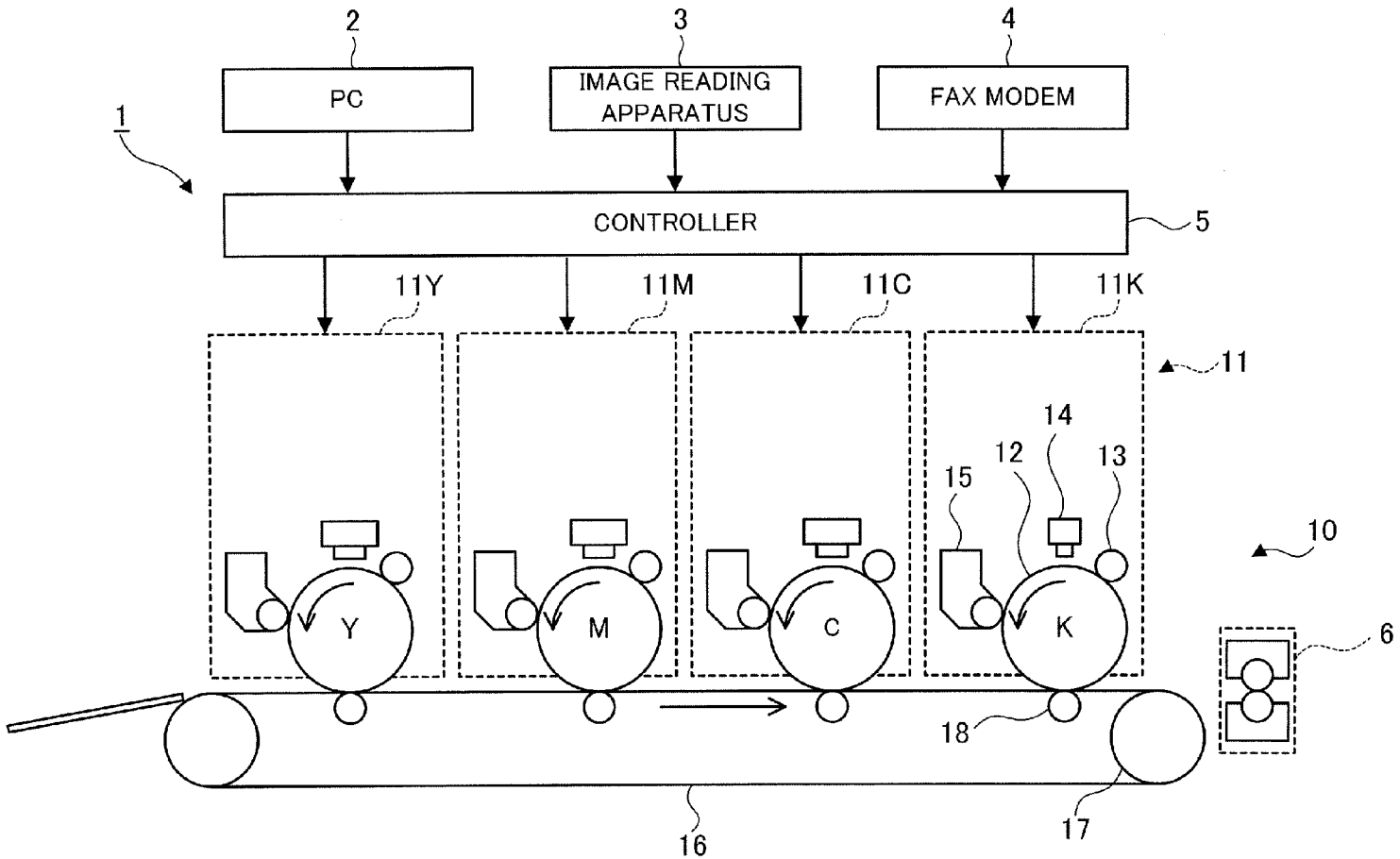
FIG. 1 is a view showing an example of an entire configuration of an image forming apparatus.

FIG. 1 is a view showing an example of an entire configuration of an image forming apparatus 1 to which the exemplary embodiment is applied. The image forming apparatus 1 includes: an image forming processor 10 that performs image formation according to image data of each color; and a controller 5 that is connected to a personal computer (PC) 2, an image reading apparatus 3, a FAX modem 4, or the like, that performs image processing on image data inputted from these devices, and also that controls an operation of the entire image forming apparatus 1.

The image forming processor 10 of the present exemplary embodiment includes four image forming units 11 (specifically, 11Y, 11M, 11C and 11K). Moreover, the image forming processor 10 includes: a transporting belt 16 that transports a sheet on which respective color toner images are multi-transferred, the toner images formed by photoconductive drums 12 each serving as an example of an image carrier of the image forming unit 11; a drive roll 17 that drives the transporting belt 16; transfer rolls 18 that respectively transfer the toner images of the photoconductive drums 12 on the sheet; and a fixing device 6 that fixes unfixed toner images on the sheet after the transfers by applying heat and pressure.

Figure 2:
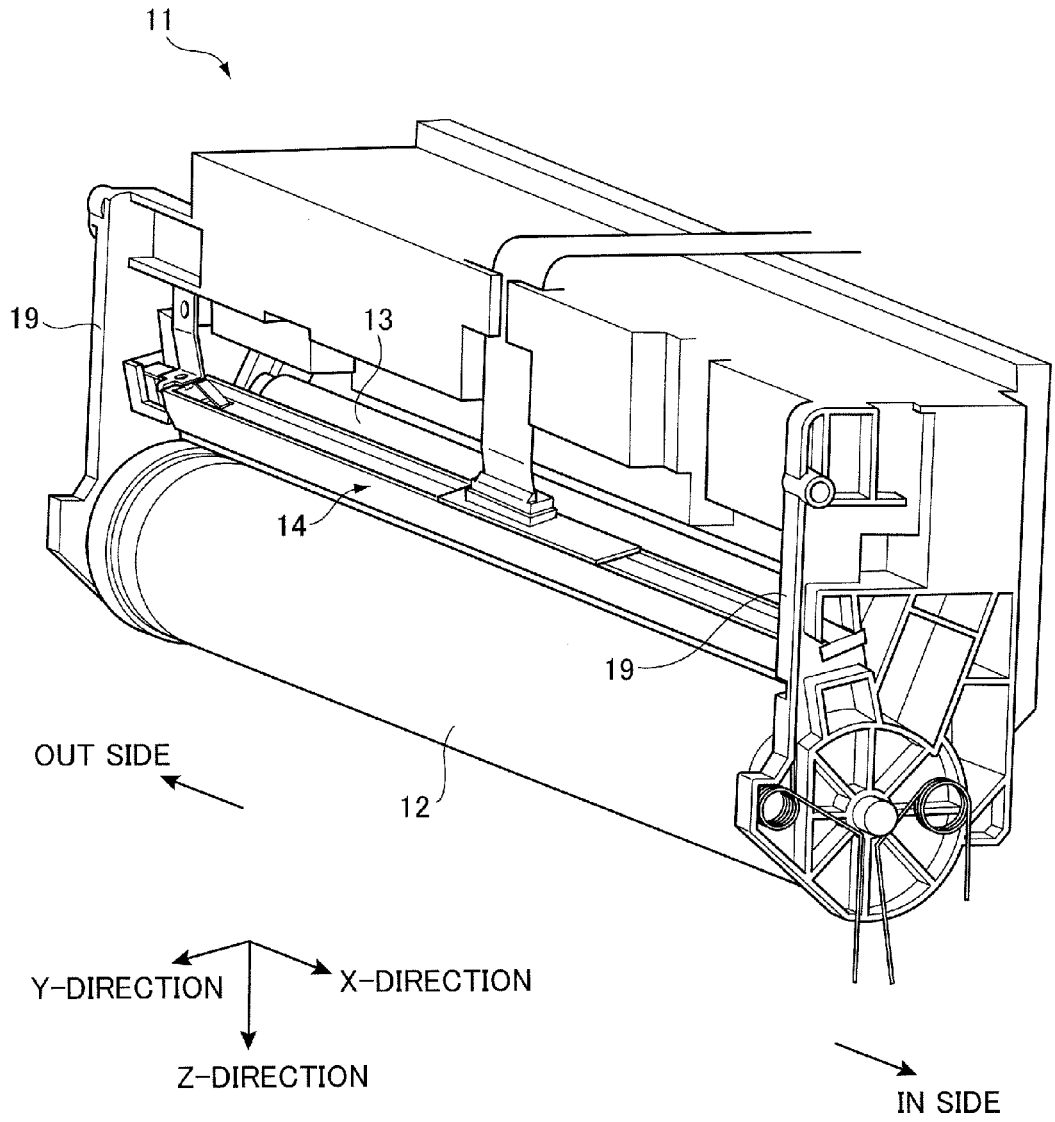
FIG. 2 is a perspective view of the image forming unit.

FIG. 2 is a perspective view of the image forming unit 11. In FIG. 2, illustration of a developing device 15 is omitted.

The image forming units 11 each include: the photoconductive drum 12; a charging device 13 as an example of a charging device that charges the photoconductive drum 12; an LED print head (LPH) 14 as an example of an exposure unit that exposes the charged photoconductive drum 12 on the basis of image data transmitted from the controller 5; and the developing device 15 (see FIG. 1) as an example of a developing device that develops an electrostatic latent image formed on the photoconductive drum 12, with toner. In addition, the image forming units 11 each include a housing 19 that holds the photoconductive drum 12, the charging device 13, the LPH 14 and the developing device 15.

In the following description, it is assumed, as indicated by arrows in FIG. 2, that a longitudinal direction of the LPH 14 (first scan direction) is an X-direction, an optical axis direction of light emitted by the LPH 14 to the photoconductive drum 12 (light-emitting direction) is a Z-direction, and a direction orthogonal to the X-direction and the Z-direction is a Y-direction. Moreover, a front side on the paper is called an IN side, and a rear side on the paper is called an OUT side, in the X-direction of the LPH 14 shown in FIG. 2. In the following description of each member or the like, it is assumed that the side of the member corresponding to the rear side on the paper, in a state where the member is attached to the image forming unit 11 shown in FIG. 2, is the OUT side, and the side of the member corresponding to the front side on the paper, in the state, is the IN side. Moreover, in the present exemplary embodiment, the OUT side corresponds to a one end side, and the IN side corresponds to a different end side. Furthermore, the X-direction corresponds to a first direction, the Y-direction corresponds to a third direction, and the Z-direction corresponds to a second direction.

Figure 3:
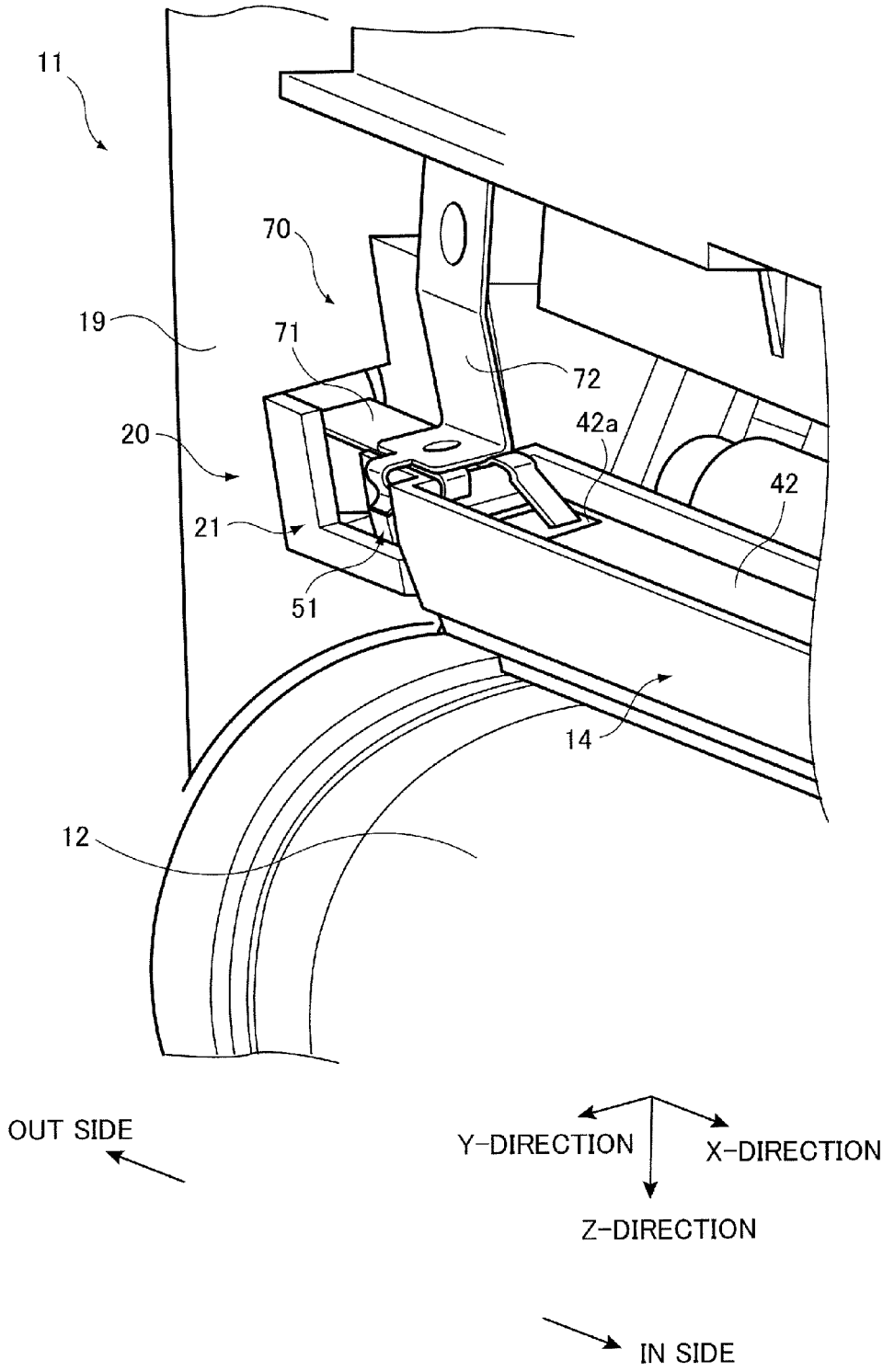
FIG. 3 is an enlarged view of the LPH near an OUT-side end part.
Figure 4:
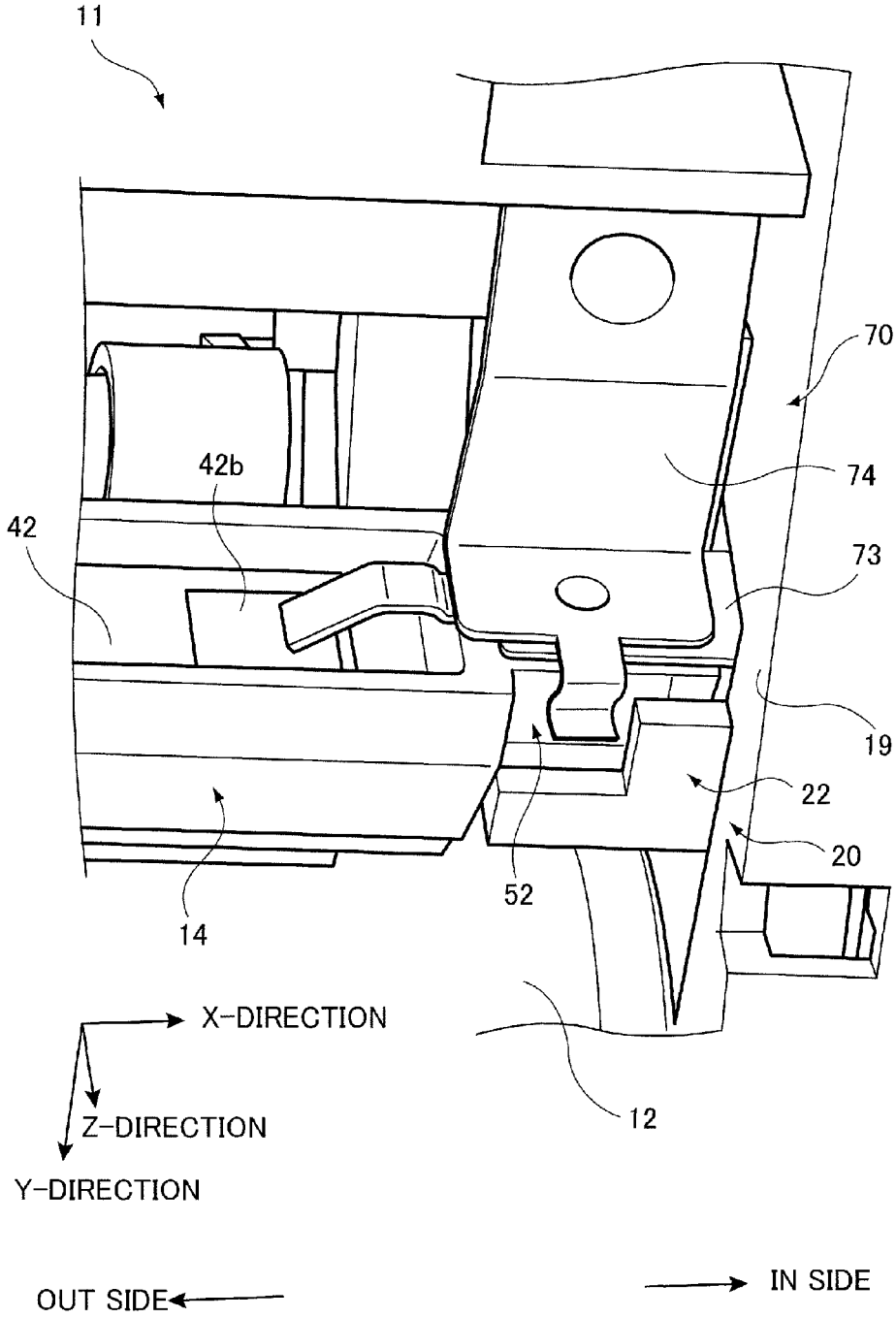
FIG. 4 is an enlarged view of the LPH near an IN-side end part.

FIG. 3 is an enlarged view of the LPH 14, shown in FIG. 2, near an OUT-side end part. FIG. 4 is an enlarged view of the LPH 14, shown in FIG. 2, near an IN-side end part.

As shown in FIG. 3 and FIG. 4, a holding portion 20 that holds the LPH 14 is provided in the housing 19. The holding portion 20 includes: an OUT-side holding portion 21 as an example of a one-end-side holding portion that holds an OUT-side end part of the LPH 14; and an IN-side holding potion 22 as an example of a different-end-side holding portion that holds an IN-side end part of the LPH 14. The LPH 14 is held at the both end parts thereof by the OUT-side holding portion 21 and the IN-side holding portion 22, and is thereby supported in the housing 19.

Moreover, the OUT-side holding portion 21 and the IN-side holding portion 22 also have a function of aligning the LPH 14. The OUT-side holding portion 21 aligns the LPH 14 in the X-direction. Also, the OUT-side holding portion 21 and the IN-side holding portion 22 align the LPH 14 in the Y-direction and in the Z-direction.

Here, the LPH 14 is fixed by fixing members 70 (a first spring member 71, a second spring member 72, a third spring member 73 and a fourth spring member 74) each serving as an example of an application portion. As shown in FIG. 3, the OUT-side end part of the LPH 14 is fixed by the fixing members 70 formed of the first spring member 71 and the second spring member 72 stacked in this order from the LPH 14 side. On the other hand, as shown in FIG. 4, the IN-side end part of the LPH 14 is fixed by the fixing members 70 formed of the third spring member 73 and the fourth spring member 74 stacked in this order from the LPH 14 side. The fixing members 70 will be described later in detail.

Figure 5B:
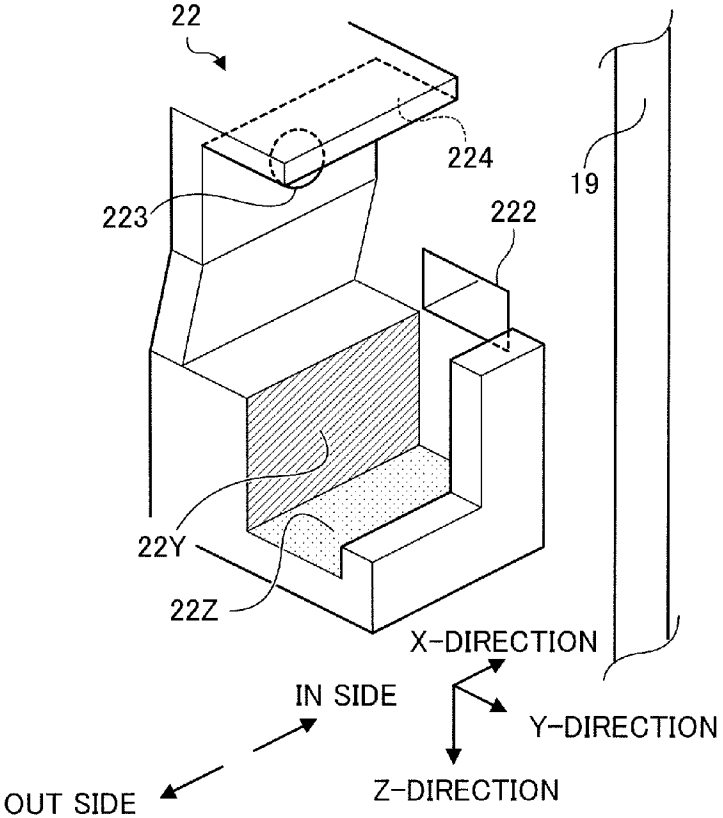
FIGS. 5A and 5B are views for explaining the holding portion provided in the housing.
Figure 5A:
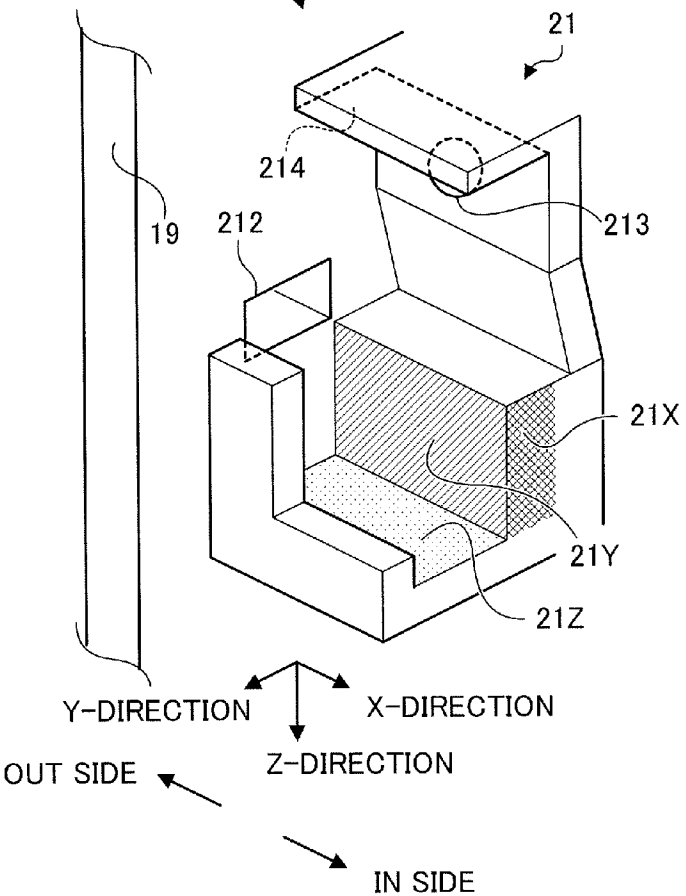

FIGS. 5A and 5B are views for explaining the holding portion 20 provided in the housing 19 of the image forming unit 11.

As shown in FIG. 5A, the OUT-side holding portion 21 includes: an X-direction reference surface 21X serving as a reference surface for X-direction alignment; a Y-direction reference surface 21Y serving as a reference surface for Y-direction alignment; and a Z-direction reference surface 21Z serving as a reference surface for Z-direction alignment. These reference surfaces are defined so that the LPH 14 would be positioned as intended with respect to the photoconductive drum 12 when being attached to the holding portion 20. Here, the X-direction reference surface 21X functions as a first reference portion, the Y-direction reference surface 21Y functions as a third reference portion, and the Z-direction reference surface 21Z functions as a second reference portion.

In addition, as shown in FIG. 5A, a through-opening 212 that penetrates the housing 19 from the outer side to the inner side thereof is formed in the OUT-side holding portion 21. The through-opening 212 is a space into which the first spring member 71 to be described later is inserted. Moreover, the OUT-side holding portion 21 includes: a screw hole 213 that is used for fastening of the second spring member 72 to be described later; and a ceiling 214 that is used for attachment of the second spring member 72.

Meanwhile, as shown in FIG. 5B, the IN-side holding portion 22 includes: a Y-direction reference surface 22Y serving as a reference surface for Y-direction alignment; and a Z-direction reference surface 22Z serving as a reference surface for Z-direction alignment. As in the case of the above-described OUT-side holding portion 21, these reference surfaces of the IN-side holding portion 22 are defined so that the LPH 14 would be positioned as intended with respect to the photoconductive drum 12 when being attached to the holding portion 20. In the present exemplary embodiment, since X-direction alignment of the LPH 14 is performed by using the X-direction reference surface 21X of the OUT-side holding portion 21, the IN-side holding portion 22 is provided with no reference surface for the X-direction.

In addition, as shown in FIG. 5B, a through-opening 222 that penetrates the housing 19 from the outer side to the inner side thereof is formed in the IN-side holding portion 22. The through-opening 222 is a space into which the third spring member 73 to be described later is inserted. Moreover, the IN-side holding portion 22 includes: a screw hole 223 that is used for fastening of the fourth spring member 74 to be described later; and a ceiling 224 that is used for attachment of the fourth spring member 74.

Figures 6A, 6B:
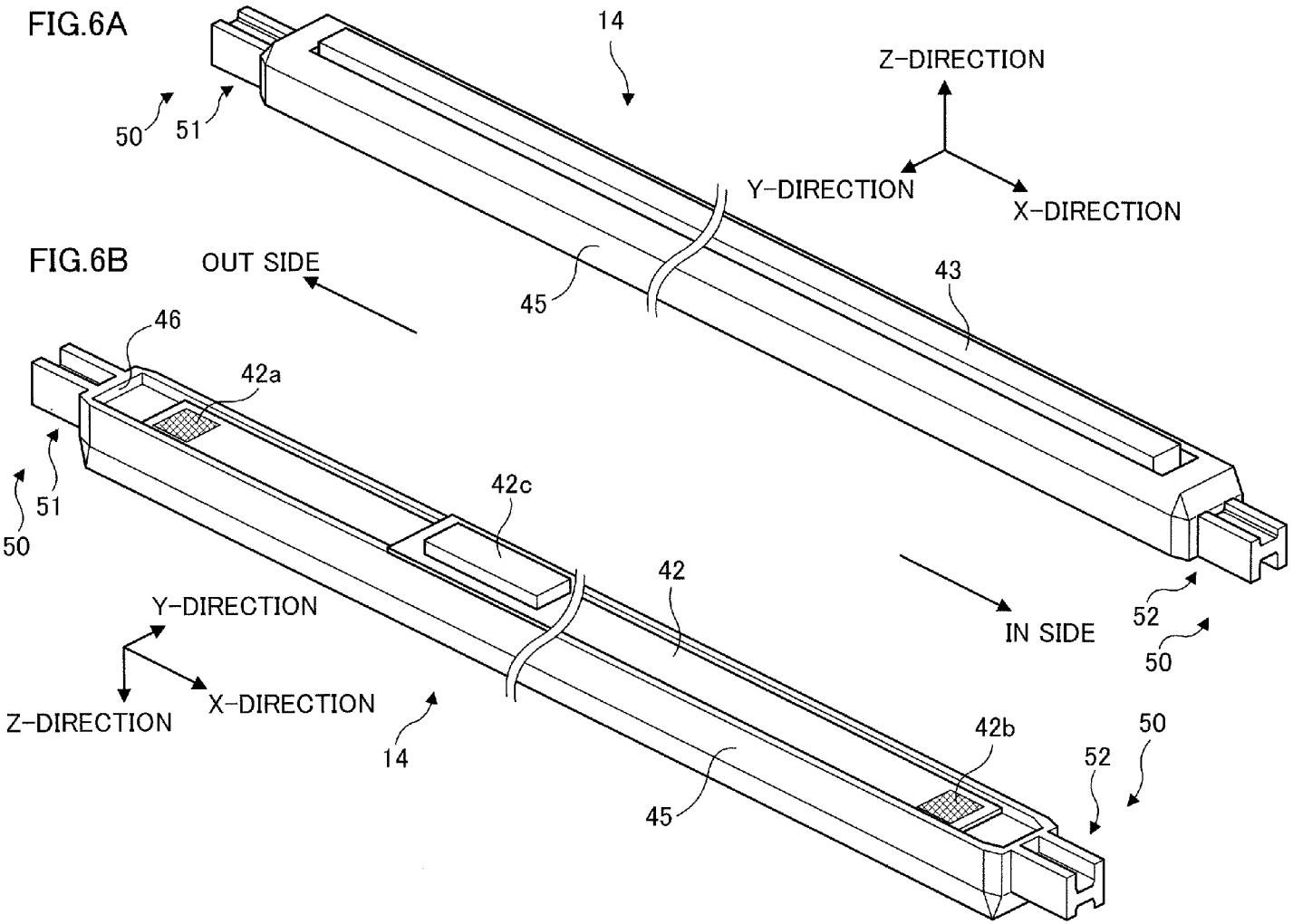
FIGS. 6A and 6B are views showing an example of the entire configuration of the LPH.

FIGS. 6A and 6B are views showing an example of the entire configuration of the LPH 14. FIG. 6A is a perspective view of the LPH 14 seen from a light-emitting side (referred to as a front surface side, below). FIG. 6B is a perspective view of the LPH 14 seen from a side opposite to the light-emitting side (referred to as a back surface side, below).

As shown in FIG. 6A, the LPH 14 includes: a light-emitting chip array 41 (see FIG. 7A to be described later); a rod lens array 43 that forms an image on a surface of the photoconductive drum 12 by using light emitted from the light-emitting chip array 41; and a holder 45 that supports the light-emitting chip array 41 and the rod lens array 43 while shielding the light-emitting chip array 41 from the outside. Moreover, the LPH 14 includes a contact part 50 that has contact surfaces which come into contact with the holding portion 20 when the LPH 14 is attached to the holding portion 20.

In addition, as shown in FIG. 6B, a circuit board 42 is provided with a ground pad 42*a* (OUT-side end part) and a ground pad 42*b* (IN-side end part) that are used for a ground connection of the LPH 14. Moreover, the circuit board 42 is provided with a connector 42*c* that receives various signals and the like for exposure operation. As shown in FIG. 6B, a receiving part 46 is formed in an OUT-side end part of the holder 45 on the back surface side of the LPH 14 so that the first spring member 71 would hook the receiving part 46 as will be described later.

Figure 7A:
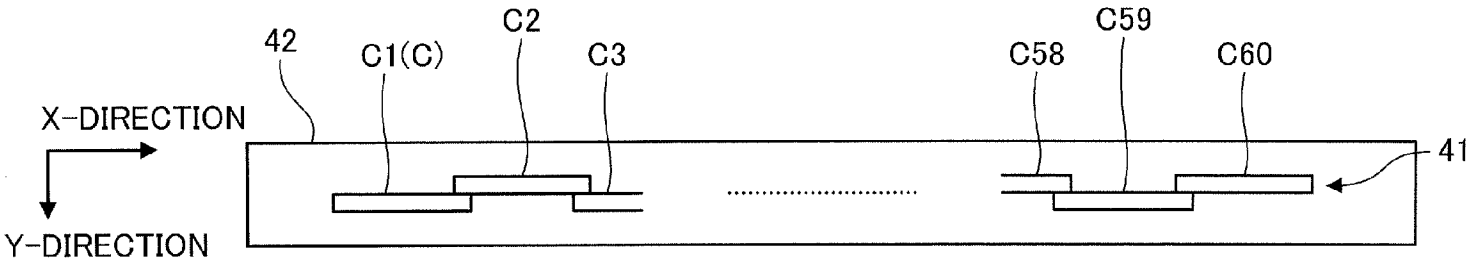
FIGS. 7A and 7B are views for explaining members forming the LPH.
Figure 7B:
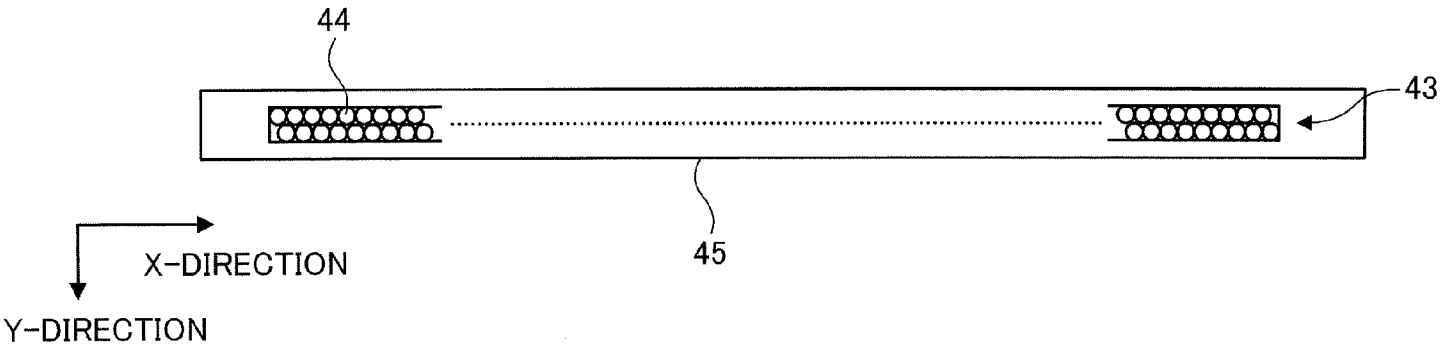

FIGS. 7A and 7B are views for explaining members forming the LPH 14. FIG. 7A is a top view of the light-emitting chip array 41 of the LPH 14, and FIG. 7B is a top view of the rod lens array 43 and the holder 45 of the LPH 14.

The light-emitting chip array 41 includes light-emitting chips C having multiple LEDs, and the circuit board 42 on which a signal generation circuit that drives each of the light-emitting chips C and various wirings are provided. Moreover, as shown in FIG. 7A, the light-emitting chip array 41 is configured by arranging, on the circuit board 42, 60 light-emitting chips C (C1 to C60) in a zigzag manner in two rows in the Y-direction.

As shown in FIG. 7B, the rod lens array 43 is configured so that the holder 45 holds multiple rod lenses 44 aligned in a staggered manner in two rows in the Y-direction. Each of the rod lenses 44 has a cylindrical shape, for example, and is configured of a gradient index lens that has the refractive index distribution in a radial direction thereof and that forms an unmagnified erecting image. An example of such a gradient index lens is a Selfoc lens (registered trademark of Nippon Sheet Glass Co., Ltd.), for example.

Figures 8A, 8B:
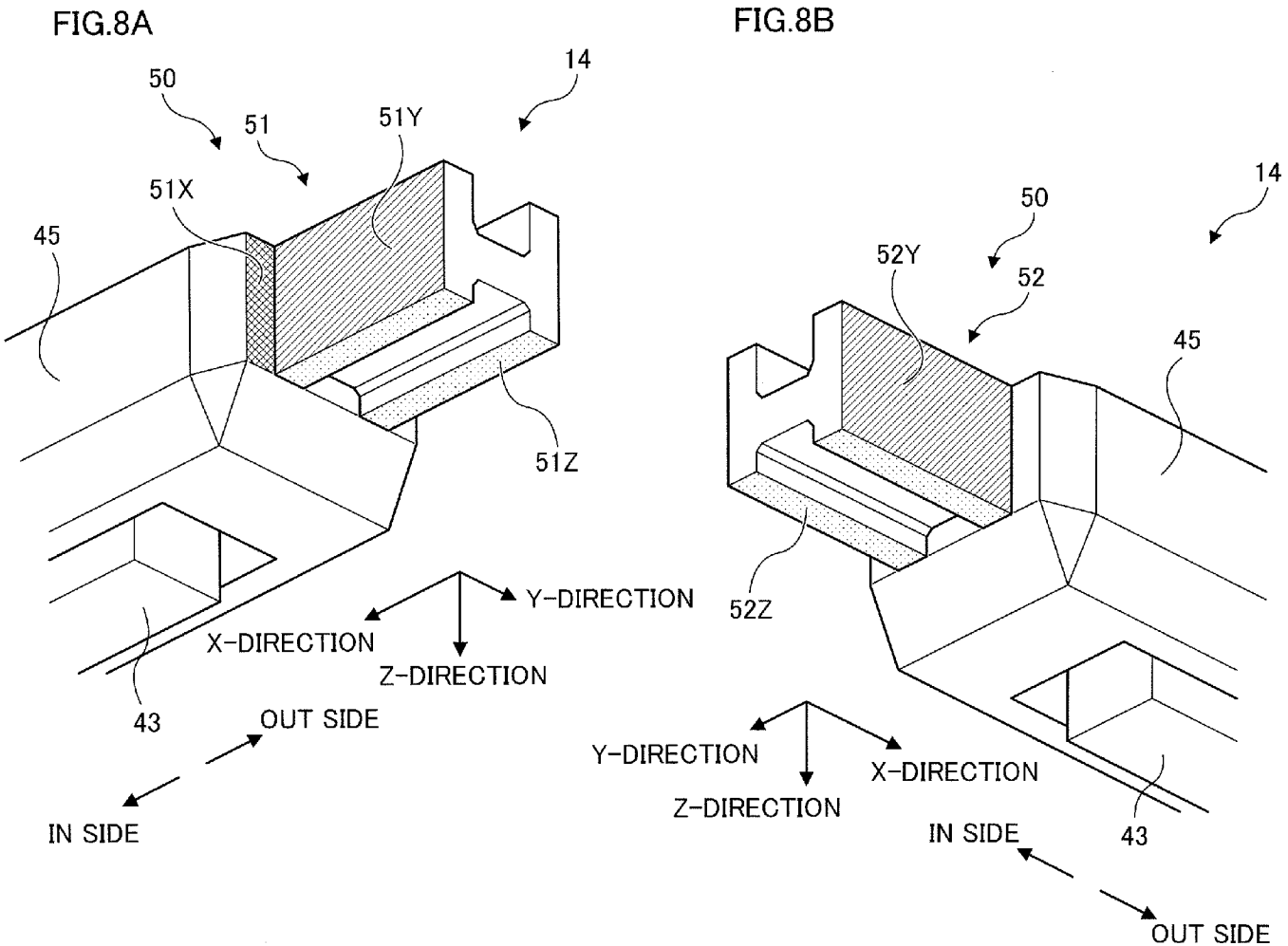
FIGS. 8A and 8B are views for explaining the contact part formed in the LPH.

FIGS. 8A and 8B are views for explaining the contact part 50 formed in the LPH 14. FIG. 8A is a view of the OUT-side end part of the LPH 14 shown in FIG. 6B, seen from the rear side on the paper. Meanwhile, FIG. 8B is a view of the IN-side end part of the LPH 14 shown in FIG. 6B, seen from the rear side on the paper.

The contact part 50 includes an OUT-side contact part 51 that is provided at the OUT-side end part of the LPH 14, and an IN-side contact part 52 that is provided at the IN-side end part of the LPH 14.

As shown in FIG. 8A, the OUT-side contact part 51 includes an X-direction contact surface 51X, a Y-direction contact surface 51Y and a Z-direction contact surface 51Z. These surfaces are to be in contact with the OUT-side holding portion 21 including the reference surfaces for alignment of the LPH 14. Specifically, the X-direction contact surface 51X is to be in contact with the X-direction reference surface 21X of the OUT-side holding portion 21. The Y-direction contact surface 51Y is to be in contact with the Y-direction reference surface 21Y of the OUT-side holding portion 21. The Z-direction contact surface 51Z is to be in contact with the Z-direction reference surface 21Z of the OUT-side holding portion 21. Thus, in the present exemplary embodiment, the LPH 14 is aligned in the X-direction, the Y-direction and the Z-direction at the IN-side end part of the LPH 14 by achieving surface contact.

On the other hand, as shown in FIG. 8B, the IN-side contact part 52 includes a Y-direction contact surface 52Y and a Z-direction contact surface 52Z. As in the case of the contact surfaces of the OUT-side contact part 51, these surfaces are to be in contact with the IN-side holding portion 22 including the reference surfaces for alignment of the LPH 14. Specifically, the Y-direction contact surface 52Y is to be in contact with the Y-direction reference surface 22Y of the IN-side holding portion 22. The Z-direction contact surface 52Z is to be in contact with the Z-direction reference surface 22Z of the IN-side holding portion 22. Thus, in the present exemplary embodiment, the LPH 14 is aligned in the Y-direction and the Z-direction at the OUT-side end part of the LPH 14 by achieving surface contact.

It is to be noted that, in the present exemplary embodiment, the LPH 14 is aligned in the X-direction by the OUT-side holding portion 21 and the OUT-side contact part 51 of the LPH 14. For this reason, the IN-side contact part 52 of the LPH 14 is provided with no X-direction contact surface.

FIGS. 9A to 9D are views for explaining the fixing members 70 to which the exemplary embodiment is applied.

As shown in FIGS. 9A to 9D, the fixing members 70 in the present exemplary embodiment are configured by including four spring members.

As described above, in the present exemplary embodiment, the LPH 14 is aligned by causing the contact surfaces formed in the contact part 50 of the LPH 14 to come into contact with the reference surfaces formed in the holding portion 20. Accordingly, the contact surfaces formed in the contact part 50 of the LPH 14 need to come into a state of being in contact with the reference surfaces formed in the holding portion 20. In addition, even while the image forming apparatus 1 is in operation, the contact state between the LPH 14 and the holding portion 20 needs to be maintained. To fulfill these requirements, in the present exemplary embodiment, the LPH 14 is fixed by the fixing members 70 at a position where the LPH 14 is aligned by the reference surfaces of the holding portions 20 and the contact surfaces of the contact parts 50.

The fixing members 70 may be of any kind as long as having enough elasticity and mechanical strength to fix the LPH 14. Moreover, in the present exemplary embodiment, the fixing member 70 is connected to the ground pad 42*a* provided on the circuit board 42, and thereby performs a part of the function for the ground connection of the LPH 14 (see FIG. 3). Accordingly, metal, having conductivity, is used for the fixing members 70 in the present exemplary embodiment. If a configuration is employed in which the fixing members 70 do not need to have conductivity, resin, for example, may be used as a material of the fixing members 70.

The fixing members 70 includes the first spring member 71 and the second spring member 72 that fix the OUT-side end part of the LPH 14. Moreover, the fixing members 70 also includes the third spring member 73 and the fourth spring member 74 that fix the IN-side end part of the LPH 14.

The first spring member 71 as an example of a first application member fixes the LPH 14 in the X-direction. As shown in FIG. 9A, the first spring member 71 is configured by including a base 71*a*, an anchor 71*b*, a hook 71*c*, a ground part 71*d* and a recess 71*e*.

The anchor 71*b* is provided on an end side of the base 71*a*. The anchor 71*b* is formed to be larger in width than the through-opening 212 of the OUT-side holding portion 21.

The hook 71*c* is provided on an end side, opposite to the side on which the anchor 71*b* is provided, of the base 71*a*. The hook 71*c* of the present exemplary embodiment has an S-shape. The hook 71*c* is configured so as to be hooked at the OUT-side end part of the LPH 14 (the receiving part 46 in the present exemplary embodiment, see FIG. 6B). Here, the length from the anchor 71*b* to the hook 71*c* is set to be enough to press the OUT-side contact part 51 toward the OUT-side holding portion 21 in a state where the housing 19, the OUT-side holding portion 21 and the OUT-side contact part 51 are sandwiched between the anchor 71*b* and the hook 71*c* (see FIG. 10).

The ground part 71*d* is set to come in contact with the ground pad 42*a* of the circuit board 42 of the LPH 14 in a state where the first spring member 71 is attached to the OUT-side holding portion 21.

In addition, as shown in FIG. 9A, the recess 71*e* depressed toward a lower side of FIG. 9A is provided at a central part of the base 71*a* in a width direction. The recess 71*e* is configured so that a projection 72*e* of the second spring member 72 to be described later may be fitted into the recess 71*e*. Moreover, in the present exemplary embodiment, the recess 71*e* has an elongated shape that is long in the X-direction, in a state of being attached to the OUT-side holding portion 21. The recess 71*e* may be an opening penetrating the base 71*a* and having an elongated shape that is long in the X-direction.

Next, the second spring member 72 will be described with reference to FIG. 9B.

The second spring member 72 as an example of a second application member fixes the LPH 14 in the Y-direction and the Z-direction at the OUT-side end part. As shown in FIG. 9B, the second spring member 72 as a whole has a 93 shape. The second spring member 72 is configured by including a base 72*a*, an opening 72*b*, a hook 72*c*, a pressing part 72*d*, the projection 72*e* and a guide 72*f*.

The opening 72*b* is provided on an end side of the base 72*a*. The opening 72*b* is used to screw the second spring member 72 to the OUT-side holding portion 21.

The pressing part 72*d* is provided on a side, opposite to the side on which the opening 72*b* is provided, of the base 72*a*. As shown in FIG. 9B, the pressing part 72*d* is formed so as to bend from the base 72*a*. The length from the opening 72*b* to the pressing part 72*d* is set to be enough to press the OUT-side contact part 51 toward the OUT-side holding portion 21 in a state where the LPH 14 is attached to the holding portion 20 (see FIG. 3) (see FIG. 11). Moreover, as shown in FIG. 9B, the hook 72*c* is formed at the pressing part 72*d*. In the present exemplary embodiment, the hook 72*c* has an S-shape.

Figure 9C:
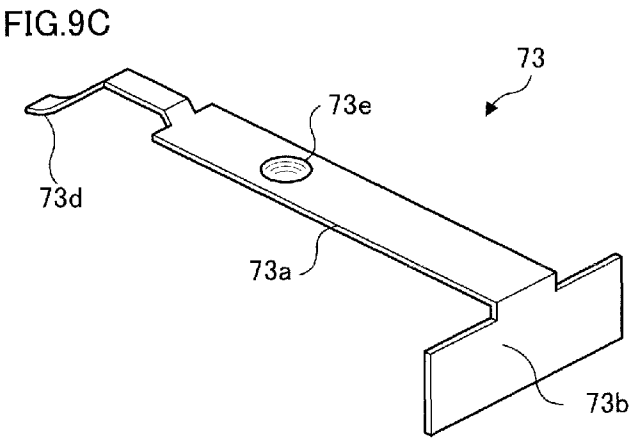
FIGS. 9A to 9D are views for explaining the fixing members.
Figure 9D:
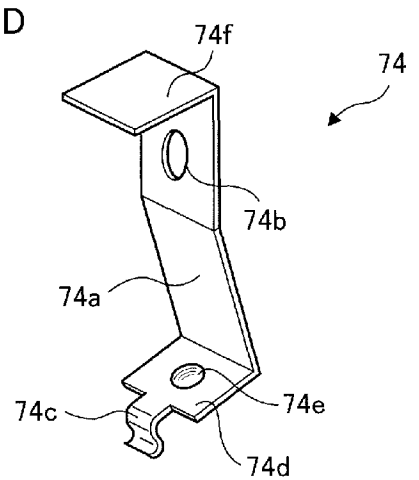
Figure 9A:
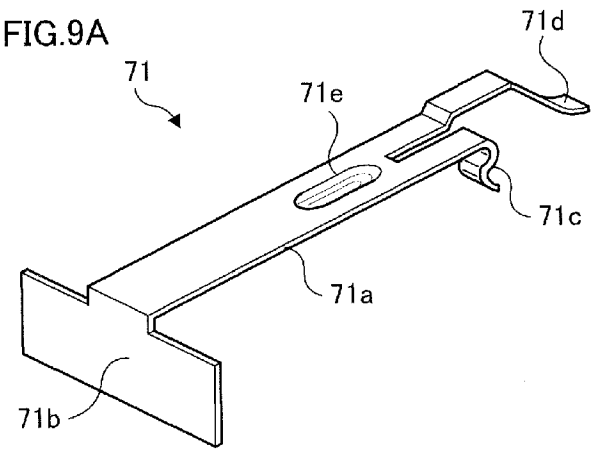
Figure 9B:
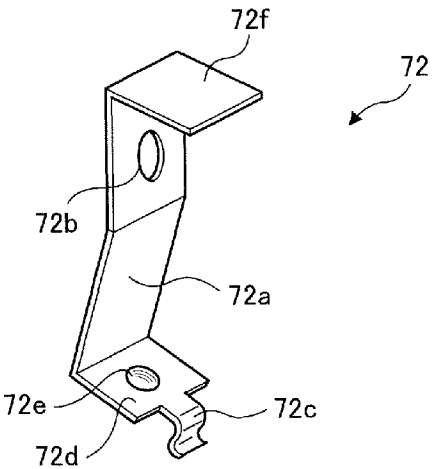

Furthermore, the projection 72*e* projecting toward a lower side of FIG. 9B is provided in the pressing part 72*d*. In the present exemplary embodiment, the projection 72*e* has a hemispheric shape, and is formed by so-called half blanking. As described above, the projection 72*e* is configured so as to be capable of fitting into the recess 71*e* of the first spring member 71. The thickness (height) of the projection 72*e* of the second spring member 72 is configured so that the projection 72*e* would be in contact with the recess 71*e* of the first spring member 71, and not with the base 71*a* of the first spring member 71, in a state where the second spring member 72 is stacked on the first spring member 71 (see FIG. 3) (see FIGS. 11A to 11C).

On a side, where the opening 72*b* is formed, of the base 72*a*, the guide 72*f* is formed so as to face the pressing part 72*d*. When the LPH 14 is fixed by the second spring member 72, the guide 72*f* is used to attach the second spring member 72.

Next, the third spring member 73 will be described with reference to FIG. 9C.

In the present exemplary embodiment, the third spring member 73 performs the function for the ground connection of the LPH 14.

As shown in FIG. 9C, the third spring member 73 is configured by including a base 73*a*, an anchor 73*b*, a ground part 73*d* and a recess 73*e*.

The anchor 73*b* is formed to be larger in width than the through-opening 222 of the IN-side holding portion 22. The ground part 73*d* is bent toward a lower side of FIG. 9C so as to be capable of being in contact with the ground pad 42*b* of the circuit board 42 of the LPH 14 in a state where the third spring member 73 is attached to the IN-side holding portion 22.

Moreover, as shown in FIG. 9C, the recess 73*e* depressed toward the lower side of FIG. 9C is provided in the base 73*a*. The recess 73*e* is configured so that a projection 74*e* of the fourth spring member 74 to be described later would be fitted into the recess 73*e*.

Next, the fourth spring member 74 will be described with reference to FIG. 9D.

The fourth spring member 74 fixes the LPH 14 in the Y-direction and the Z-direction at the IN-side end part. In the present exemplary embodiment, the fourth spring member 74 has the same basic configuration as the second spring member 72. As shown in FIG. 9D, the fourth spring member 74 as a whole has a Z shape. Moreover, the fourth spring member 74 is configured by including a base 74*a*, an opening 74*b*, a hook 74*c*, a pressing part 74*c*, the projection 74*e* and a guide 74*f*.

The opening 74*b* is used to screw the fourth spring member 74 itself to the IN-side holding portion 22. The pressing part 74*c* of the fourth spring member 74 applies force in the Z-direction to the LPH 14 in a state of being attached to the IN-side holding portion 22. Moreover, the hook 74*c* applies force in the Y-direction to the IN-side end part of the LPH 14 in a state of being attached to the IN-side holding portion 22.

The projection 74*e* of the fourth spring member 74 is configured by being capable of fitting into the recess 73*e* of the third spring member 73. The thickness (height) of the projection 74*e* of the fourth spring member 74 is set so that the projection 74*e* would be in contact with the recess 73*e* of the third spring member 73, and not with the base 73*a* of the third spring member 73, in a state where the fourth spring member 74 is stacked on the third spring member 73 (see FIG. 4).

The guide 74*f* is used to attach the fourth spring member 74 to the IN-side holding portion 22.

Next, a procedure of attaching the LPH 14 to the holding portion 20 will be described.

Figure 10A:
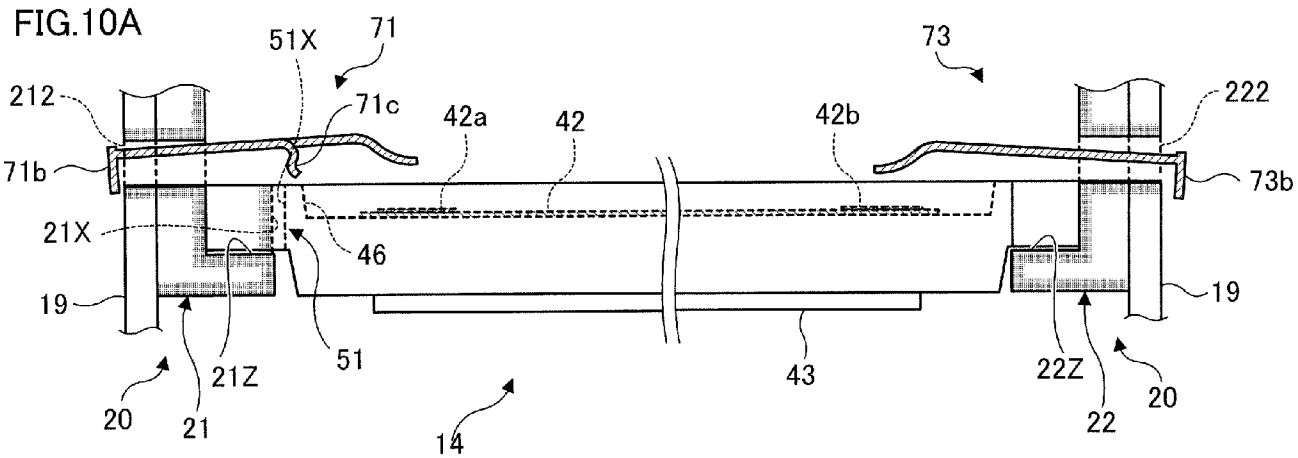
FIGS. 10A and 10B are views for explaining fixing of the LPH in the X-direction.
Figure 10B:
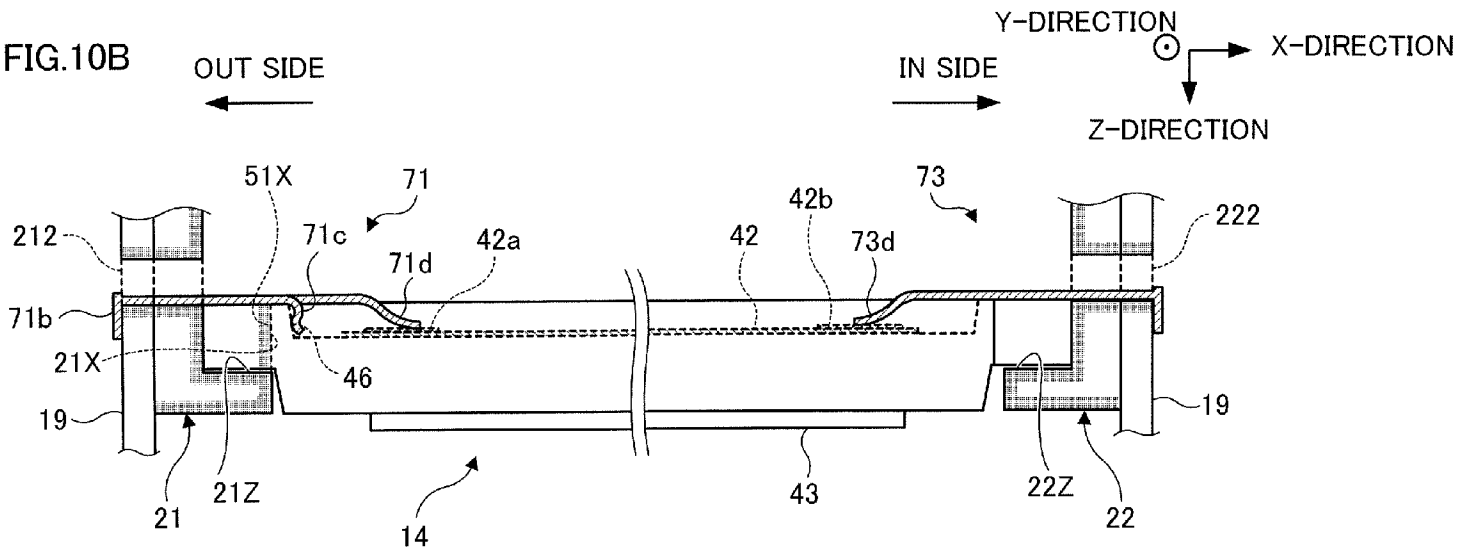
Figure 11A:
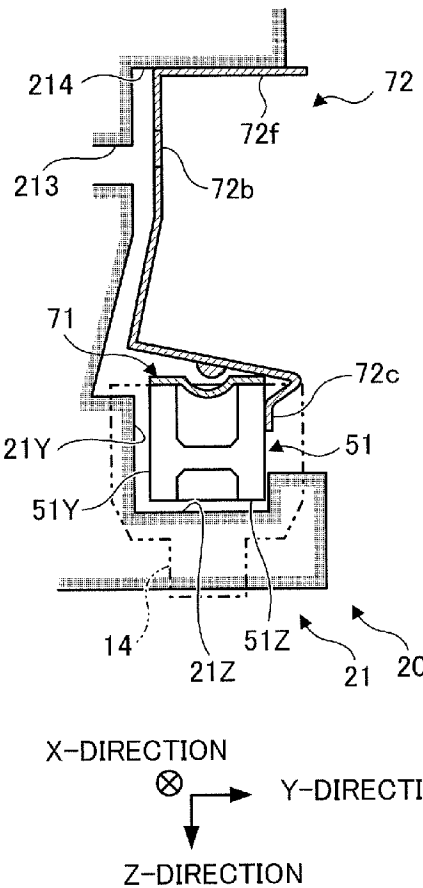
FIGS. 11A to 11C are views for explaining fixing of the LPH in the Y-direction and the Z-direction.
Figure 11B:
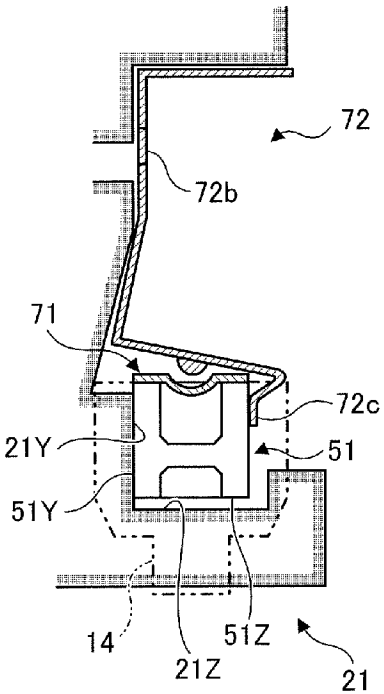
Figure 11C:
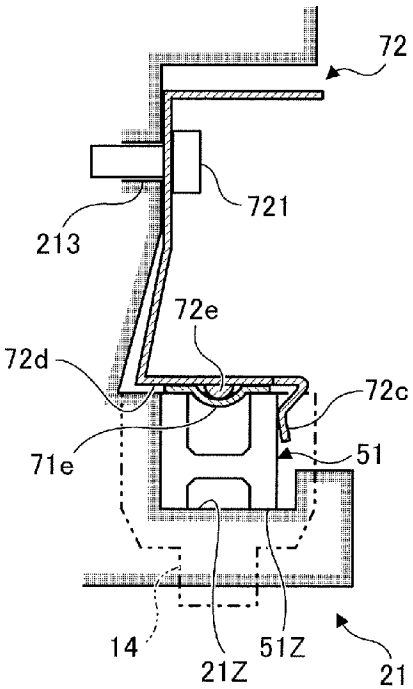

FIGS. 10A and 10B are views for explaining fixing of the LPH 14 in the X-direction by the first spring member 71. FIGS. 11A to 11C are views for explaining fixing of the LPH 14 in the Y-direction and the Z-direction by the second spring member 72. Here, the fixing of the LPH 14 in the Y-direction and the Z-direction will be described by taking the case of the second spring member 72 as an example.

In order to attach the LPH 14 to the holding portion 20, first, the LPH 14 is placed on the holding portion 20 so that the front surface side of the LPH 14 would face the photoconductive drum 12 side. Specifically, the OUT-side contact part 51 of the LPH 14 is placed on the OUT-side holding portion 21, and the IN-side contact part 52 of the LPH 14 is placed on the IN-side holding portion 22.

At this event, the OUT-side contact part 51 of the LPH 14 and the OUT-side holding portion 21 of the holding portion 20 are disposed so that the X-direction reference surface 21X and the X-direction contact surface 51X would face each other, the Y-direction reference surface 21Y and the Y-direction contact surface 51Y would face each other and the Z-direction reference surface 21Z and the Z-direction contact surface 51Z would face each other. Meanwhile, the IN-side contact part 52 of the LPH 14 and the IN-side holding portion 22 of the holding portion 20 are disposed so that the Y-direction reference surface 22Y and the Y-direction contact surface 52Y would face each other and the Z-direction reference surface 22Z and the Z-direction contact surface 52Z would face each other.

Then, as shown in FIG. 10A, at the OUT-side end part of the LPH 14, the first spring member 71 is let through the through-opening 212 and then inserted into the inner side of the housing 19. Meanwhile, at the IN-side end part of the LPH 14, the third spring member 73 is let through the through-opening 222 and then inserted into the inner side of the housing 19.

Thereafter, as shown in FIG. 10B, the hook 71*c* of the first spring member 71 is hooked to the OUT-side end part (the receiving part 46, in the present exemplary embodiment) of the holder 45 of the LPH 14. Thereby, the housing 19, the OUT-side holding portion 21 and the OUT-side contact part 51 are sandwiched between the anchor 71*b* and the hook 71*c*. At this event, the X-direction contact surface 51X of the OUT-side contact part 51 is pressed against the X-direction reference surface 21X of the OUT-side holding portion 21 by elastic force of the first spring member 71. As a result, the X-direction contact surface 51X of the OUT-side contact part 51 of the LPH 14 is fixed while being in contact with the X-direction reference surface 21X of the OUT-side holding portion 21. In short, the fixing of the LPH 14 in the X-direction is completed.

Here, when the hook 71*c* of the first spring member 71 is hooked to the OUT-side end part of the holder 45 of the LPH 14, the ground part 71*d* of the first spring member 71 also comes into contact with the ground pad 42*a* provided on the circuit board 42.

Meanwhile, as shown in FIG. 10B, the third spring member 73 is disposed so that the ground part 73*d* would be placed at a position where the ground pad 42*b* of the circuit board 42 is provided.

Then, the second spring member 72 and the fourth spring member 74 are further attached to the LPH 14, to which the first spring member 71 and the third spring member 73 have been attached.

As shown in FIG. 11A, the second spring member 72 is inserted into a space formed by the back surface of the OUT-side contact part 51 of the LPH 14 and the ceiling 214 of the OUT-side holding portion 21. At this event, the guide 72*f* of the second spring member 72 is inserted by sliding the guide 72*f* along the ceiling 214. Thereby, the second spring member 72 is less likely to be caught by the ceiling 214, thus improving attachment workability.

Then, as shown in FIG. 11B, the second spring member 72 is further pressed toward the Y-direction reference surface 21Y. Thereby, the hook 72*c* of the second spring member 72 comes into contact with a side surface of the OUT-side contact part 51. At this event, force toward the Y-direction reference surface 21 starts to be applied to the OUT-side contact part 51. With this force, if there is a space between the Y-direction contact surface 51Y and the Y-direction reference surface 21Y as shown in FIG. 11A, the Y-direction contact surface 51Y starts to move toward the Y-direction reference surface 21Y. Moreover, by pressing the second spring member 72 toward the Y-direction reference surface 21Y, the Y-direction contact surface 51Y of the OUT-side contact part 51 comes to be pressed against the Y-direction reference surface 21Y.

Lastly, as shown in FIG. 11C, the second spring member 72 is screwed to the OUT-side holding portion 21 with a screw 721. At this event, the second spring member 72 is pressed down so that the opening 72*b* of the second spring member 72 would be aligned with the screw hole 213 of the OUT-side holding portion 21. Thereby, the pressing part 72*d* of the second spring member 72 comes into contact with the first spring member 71. Then, as shown in FIG. 11C, the projection 72*e* of the pressing part 72*d* is fitted into the recess 71*e* of the first spring member 71. Elastic force of the second spring member 72 is transmitted to the OUT-side contact part 51 through the first spring member 71. At this event, if there is a space between the Z-direction contact surface 51Z and the Z-direction reference surface 21Z as shown in FIG. 11B, the Z-direction contact surface 51Z starts to move toward the Z-direction reference surface 21Z. Thereby, the Z-direction contact surface 51Z of the OUT-side contact part 51 comes to be pressed against the Z-direction reference surface 21Z.

As described above, through the attachment of the second spring member 72, the projection 72*e* of the second spring member 72 is fitted into the recess 71*e* of the first spring member 71. Thereby, the first spring member 71 is fixed so as not to move in the Y-direction or the Z-direction. This also applies to the relationship between the third spring member 73 and the fourth spring member 74, description of which is omitted here. In addition, by the pressing of the first spring member 71 and the third spring member 73, the ground part 71*d* of the first spring member 71 and the ground pad 42*a* are fixed, and the ground part 73*d* of the third spring member 73 and the ground pad 42*b* are fixed.

Moreover, in the present exemplary embodiment, the recess 71*e* of the first spring member 71 is a long hole that is long in the X-direction. This configuration allows the projection 72*e* of the second spring member 72 to be fitted into the recess 71*e* of the first spring member 71 in the present exemplary embodiment, even when there is an error in size in the X-direction of the holder 45 of the LPH 14 or the first spring member 71, for example.

Furthermore, in the present exemplary embodiment, the recess 71*e* of the first spring member 71 and the projection 72*e* of the second spring member 72 are configured to be in contact with each other. In other words, the relationship between the second spring member 72 and the first spring member 71 is point contact. With this configuration, even when the second spring member 72 is obliquely fixed at the time of screwing the second spring member 72, for example, force is receivable by the recess 71*e* provided at the central part of the base 71*a* of the first spring member 71. Thereby, the first spring member 71 having received the force at the central part of the base 71*a* is capable of pressing the OUT-side contact part 51 in the Z-direction with the entire base 71*a* as shown in FIG. 11C.

Next, spring force of each of the above-described spring members of the fixing members 70 will be described.

FIGS. 12A to 12D are schematic views for explaining the spring force of the fixing members 70. Here, fixing of the OUT-side end part of the LPH 14 will be described as an example.

In the following description, a force in the X-direction, which the first spring member 71 applies to the OUT-side contact part 51, is referred to as "X-direction spring force $N_X$." The force in the Y-direction, which the second spring member 72 applies to the OUT-side contact part 51, is referred to as "Y-direction spring force $N_Y$." The force in the Z-direction, which the second spring member 72 applies to the OUT-side contact part 51, is referred to as "Z-direction spring force $N_Z$." Here, the X-direction spring force $N_X$, the Y-direction spring force $N_Y$ and the Z-direction spring force $N_Z$ are such force that the LPH 14 would not be displaced with respect to the holding portion 20 by vibrations which the LPH 14 receives or the like when the image forming apparatus 1 is in operation, for example.

In the present exemplary embodiment, each surface of the OUT-side holding portion 21 is made of the same material. Moreover, each surface of the OUT-side contact part 51 is also made of the same material. Accordingly, static friction coefficients μ between the X-direction reference surface 21X and the X-direction contact surface 51X, between the Y-direction reference surface 21Y and the Y-direction contact surface 51Y, and the Z-direction reference surface 21Z and the Z-direction contact surface 51Z are the same.

In the present exemplary embodiment, the force applied in the respective directions by the first spring member 71 and the second spring member 72 is set so that the following force relationships hold.

$$N_Y > \mu N_X \quad \text{(Expression 1)}$$

$$N_Z > (\mu N_X + \mu N_Y) \quad \text{(Expression 2)}$$

First, description will be given of Expression 1.

Figure 12A:
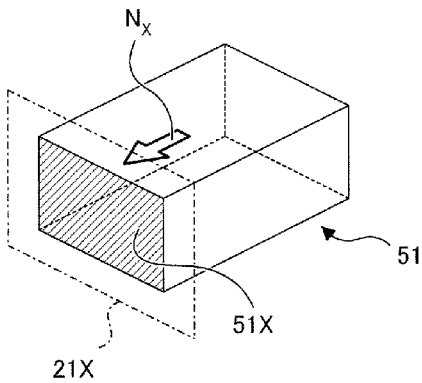
FIGS. 12A to 12D are schematic views for explaining the spring force of the fixing members.
Figure 12A:
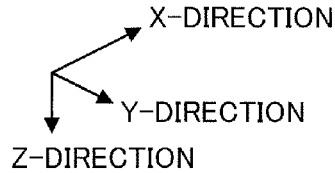

As shown in FIG. 12A, in the present exemplary embodiment, first, the X-direction contact surface 51X is pressed against the X-direction reference surface 21X by the first spring member 71 with the X-direction spring force $N_X$.

Figure 12B:
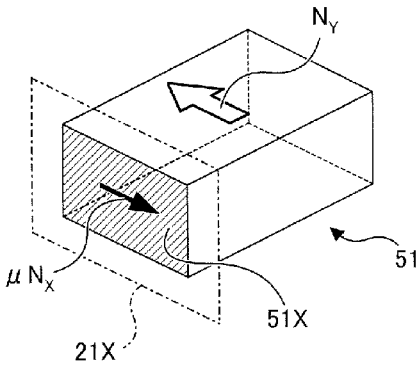

Then, as shown in FIG. 12B, the Y-direction contact surface 51Y is to move toward the Y-direction reference surface 21Y by the second spring member 72. Here, the X-direction contact surface 51X and the X-direction reference surface 21X are already in contact as described above. For this reason, to move the Y-direction contact surface 51Y toward the Y-direction reference surface 21Y, the Y-direction spring force $N_Y$ needs to be set larger than the maximum static friction force ($\mu N_X$) between the X-direction contact surface 51X and the X-direction reference surface 21X.

Description will be given of Expression 2 below.

Figure 12C:
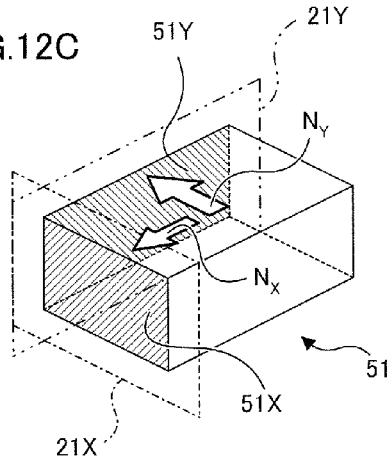
Figure 12D:
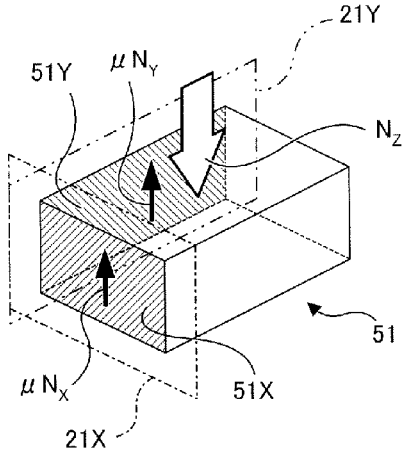

As shown in FIG. 12C, the second spring member 72 brings the Y-direction contact surface 51Y into contact with the Y-direction reference surface 21Y with the Y-direction spring force $N_Y$, when the condition shown as Expression 1 is satisfied. In this stage, the X-direction contact surface 51X is in contact with the X-direction reference surface 21X, and the Y-direction contact surface 51Y is in contact with the Y-direction reference surface 21Y. For this reason, in order to move the Z-direction contact surface 51Z toward the Z-direction reference surface 21Z, the Z-direction spring force $N_Z$ needs to be set larger than the sum of the maximum static friction force ($\mu N_X$) between the X-direction contact surface 51X and the X-direction reference surface 21X and the maximum static friction force ($\mu N_Y$) between the Y-direction contact surface 51Y and the Y-direction reference surface 21Y.

In the present exemplary embodiment, the first spring member 71 and the second spring member 72 are set so that the relationships between the forces to be applied to the LPH 14 in the respective directions would hold. Moreover, in the present exemplary embodiment, the LPH 14 is fixed to the holding portion 20 by attaching the fixing members 70 so that the force in the X-direction, the force in the Y-direction and the force in the Z-direction would be applied to the LPH 14 in this order. Thus, in the present exemplary embodiment, the spring force of each of the spring members is thus set, and the spring members are attached in the above-described order. In this way, each of the contact surfaces of the contact part 50 of the LPH 14 is reliably fixed to the corresponding reference surface of the holding portion 20.

As described above, in the present exemplary embodiment, the first spring member 71, provided to the OUT-side end part of the LPH 14, presses the OUT-side end part of the LPH 14 against the OUT-side holding portion 21, in other words, the first spring member 71 applies the force in the X-direction to the end part that is on the same side as the holding portion, thereby fixing the LPH 14 in the X-direction. In contrast with this, the LPH 14 may be fixed in such a manner that the IN-side end part of the LPH 14, for example, applies force in the X-direction toward the OUT-side holding portion 21 to press the LPH 14 against the OUT-side holding portion 21, in other words, the IN-side end part applies force in the X-direction to the end part that is on the opposite side to the holding portion. In this case, however, the force in the X-direction comes to act on the LPH 14 from the end parts of both sides of the LPH 14 toward the inner side of the LPH 14, and consequently compressive force is applied to the light-emitting area, such as the light-emitting chip array 41 and the rod lens array 43, of the LPH 14. This compressive force may cause deformation of LEDs mounted on the light-emitting chip array 41 and the rod lenses 44, and thus the spaces between the LEDs or the rod lenses 44 may become different from designed ones.

By contrast, in the present exemplary embodiment, the OUT-side end part of the LPH 14 is pulled toward the OUT-side holding portion 21 to fix the LPH 14. Accordingly, the force in the X-direction acting on the LPH 14 by the OUT-side holding portion 21 and the first spring member 71 acts only on the OUT-side end part. With this configuration, the X-direction force to act on the light-emitting area such as the light-emitting chip array 41 and the rod lens array 43 of the LPH 14 is reduced compared with the case in which the LPH 14 is pressed against the OUT-side holding portion 21 by applying force in the X-direction from the IN-side end part of the LPH 14 toward the OUT-side holding portion 21. Accordingly, compared with the case in which fixing is done by applying force from the IN-side end part of the LPH 14 toward the OUT-side holding portion 21, deformation of the light-emitting area such as the light-emitting chip array 41 and the rod lens array 43 of the LPH 14 is reduced.

It is to be noted that, although the single spring member (the second spring member 72 or the fourth spring member 74) is used for the fixing of the LPH 14 in the Y-direction and the Z-direction in the present exemplary embodiment, the fixing is not limited thereto. What is needed here is only to be capable of pressing each of the contact surfaces, provided in the respective directions of the contact part 50 of the LPH 14, against the reference surface, in the corresponding direction, of the holding portion 20. Accordingly, for example, a member that fixes the LPH 14 in the X-direction, a member that fixes the LPH 14 in the Y-direction and a member that fixes the LPH 14 in the Z-direction may be individual members.

Moreover, the first spring member 71 performs the function for the ground connection of the LPH 14 in the present exemplary embodiment. However, the ground connection of the LPH 14 may be made by configuring, for example, the second spring member 72 to come into contact with the ground pad 42*a*.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure device comprising:

an exposure unit that has one end and a different end, that includes a plurality of light-emitting elements arranged in a first direction along a direction of a rotational axis of a rotating image carrier, and that exposes the image carrier;

a one-end-side holding portion that holds a one end part, on the one end side, of the exposure unit;

a first reference part that is formed in the one-end-side holding portion, and that serves as a reference for aligning the exposure unit in the first direction by bringing the one end part of the exposure unit into contact with the first reference part; and an application portion that applies force with which the one end part of the exposure unit is pressed in the first direction against the first reference part, the force being applied locally at the one end side.

2. The exposure device according to claim 1, further comprising a different-end-side holding portion that holds a different end part, on the different end side, of the exposure unit, wherein the different-end-side holding portion holds the exposure unit so that the exposure unit is movable in the first direction.

3. The exposure device according to claim 1, wherein the first reference part is a surface, a contact surface that is caused to come in contact with the surface of the first reference part is formed in the one end part of the exposure unit, and the application portion presses the contact surface of the exposure unit against the surface of the first reference part, and contact between the surface of the first reference part and the contact surface is kept.

4. The exposure device according to claim 1, wherein the application portion performs a function for a ground connection of the exposure unit.

5. The exposure device according to claim 1, wherein a second reference part and a third reference part are further formed in the one-end-side holding portion, the second reference part serving as a reference for aligning the exposure unit in a second direction along a light-emitting direction of the exposure unit by bringing the one end part of the exposure unit into contact with the second reference part, the third reference part aligning the exposure unit in a third direction along a direction orthogonal to the first direction and the second direction by bringing the one end part of the exposure unit into contact with the third reference part, and the application portion presses the one end part of the exposure unit against each of the first reference part, the second reference part and the third reference part.

6. An image forming apparatus comprising:

an image carrier that rotates;

a charging device that charges the image carrier;

an exposure unit that has one end and a different end, that includes a plurality of light-emitting elements arranged in a first direction along a direction of a rotational axis of the image carrier, and that exposes the image carrier to form an electrostatic latent image on the image carrier;

a one-end-side holding portion that holds a one end part, on the one end side, of the exposure unit;

a first reference part that is formed in the one-end-side holding portion, and that serves as a reference for aligning the exposure unit in the first direction by bringing the one end part of the exposure unit into contact with the first reference part;

an application portion that applies force with which the one end part of the exposure unit is pressed in the first direction against the first reference part, the force being applied locally at the one end side; and a developing device that develops the electrostatic latent image formed on the image carrier to form an image.

7. The image forming apparatus according to claim 6, wherein a second reference part and a third reference part are further formed in the one-end-side holding portion, the second reference part serving as a reference for aligning the exposure unit in a second direction along a light-emitting direction of the exposure unit by bringing the one end part of the exposure unit into contact with the second reference part, the third reference part aligning the exposure unit in a third direction along a direction orthogonal to the first direction and the second direction by bringing the one end part of the exposure unit into contact with the third reference part, and the application portion presses the one end part of the exposure unit against each of the first reference part, the second reference part and the third reference part.

8. The image forming apparatus according to claim 7, wherein force with which the application portion presses the one end side of the exposure unit against the first reference part is set so as not to prevent movement of the one end part of the exposure unit in the third direction.

9. The image forming apparatus according to claim 7, wherein force with which the application portion presses the one end side of the exposure unit against each of the first reference part and the third reference part is set so as not to prevent movement of the one end part of the exposure unit in the second direction.

10. The image forming apparatus according to claim 7, wherein the application portion includes a first application member and a second application member, the first application member applying force in the first direction to the one end part of the exposure unit, the second application member applying force in each of the second direction and the third direction to the one end part of the exposure unit, and the first application member is sandwiched between the second application member and the one end part of the exposure unit, and the second application member presses the first application member and the one end part of the exposure unit against the second reference part.

11. The image forming apparatus according to claim 10, wherein the second application member includes a projection formed on the second application member, and brings the projection into contact with the first application member.

12. The image forming apparatus according to claim 11, wherein the first application member includes a recess formed in the first application member, the recess being long in the first direction, and the projection of the second application member is fitted into the recess of the first application member.

13. The exposure device according to claim 1, wherein the one-end-side holding portion comprises a hook portion that hooks the one-end-part of the exposure unit.

14. An exposure device comprising:

an exposure unit that includes a first end portion, a second end portion, and a plurality of light-emitting elements arranged in a longitudinal direction of the exposure unit, the light-emitting elements disposed between the first end portion and the second end portion, and that exposes an image carrier, the first end portion comprising a contact portion; and a holding member that is disposed at the first end portion and that comprises a first reference portion which serves as a reference for aligning the exposure unit in the longitudinal direction, and a hook which hooks the first end portion of the exposure unit and pulls the first end portion in the longitudinal direction of the exposure unit toward the first reference portion, the contact portion of the exposure unit contacting the first reference portion when the exposure unit is aligned by the holding member, wherein the second end portion is free from restraint in the longitudinal direction.

* * * * *